US011766085B2

(12) United States Patent
Weber et al.

(10) Patent No.: US 11,766,085 B2
(45) Date of Patent: Sep. 26, 2023

(54) OMNIDIRECTIONAL ENERGY MANAGEMENT SYSTEMS AND METHODS

(71) Applicant: 6D Helmets, LLC, Brea, CA (US)

(72) Inventors: Robert Weber, Fullerton, CA (US); Robert Daniel Reisinger, Newhall, CA (US)

(73) Assignee: 6D Helmets, LLC, Brea, CA (US)

( * ) Notice: Subject to any disclaimer, the term of this patent is extended or adjusted under 35 U.S.C. 154(b) by 235 days.

(21) Appl. No.: 17/086,290

(22) Filed: Oct. 30, 2020

(65) Prior Publication Data

US 2021/0045487 A1 Feb. 18, 2021

Related U.S. Application Data

(63) Continuation-in-part of application No. 16/792,172, filed on Feb. 14, 2020, now abandoned, and a continuation of application No. PCT/US2019/030072, filed on Apr. 30, 2019, said application No. 16/792,172 is a continuation of application No. 15/186,418, filed on Jun. 17, 2016, now Pat. No. 10,561,192, which is a continuation-in-part of application No. 14/607,004, filed on Jan. 27, 2015, now Pat. No. 9,820,525, which is a continuation of application No. 13/368,866, filed on Feb. 8, 2012, now Pat. No. 8,955,169.

(60) Provisional application No. 62/665,427, filed on May 1, 2018, provisional application No. 62/188,598, filed on Jul. 3, 2015, provisional application No. 62/181,121, filed on Jun. 17, 2015, provisional (Continued)

(51) Int. Cl.
*A42B 3/12* (2006.01)
*A42B 3/06* (2006.01)

(52) U.S. Cl.
CPC ..... *A42B 3/125* (2013.01); *A42B 3/064* (2013.01)

(58) Field of Classification Search
CPC ..... A42B 3/125; A42B 3/064
See application file for complete search history.

(56) References Cited

U.S. PATENT DOCUMENTS 2,434,641 A * 1/1948 Burns ..... A61G 7/05769 267/117
3,039,108 A 6/1962 Lohrenz (Continued)

FOREIGN PATENT DOCUMENTS

CA 693175 8/1964
CN 1316207 10/2001

(Continued)

*Primary Examiner* — Khaled Annis
(74) *Attorney, Agent, or Firm* — Haynes and Boone, LLP

(57) ABSTRACT

Systems and methods of a safety helmet for protecting the human head against repetitive impacts, moderate impacts and severe impacts so as to significantly reduce the likelihood of both translational and rotational brain injury and concussions can be provided. The helmet can include an outer shell, an outer liner disposed within and coupled to the outer shell, and an inner liner disposed within and coupled in spaced opposition to the outer liner. A polymer liner can be coupled to the inner liner and can at least partly separate the outer liner and the inner liner. Pads and dampers can also couple the outer liner and inner liner and provide for and control omnidirectional movement of the liners relative to each other.

20 Claims, 8 Drawing Sheets

Related U.S. Application Data application No. 61/554,351, filed on Nov. 1, 2011, provisional application No. 61/462,914, filed on Feb. 9, 2011.

(56) References Cited

U.S. PATENT DOCUMENTS 3,413,656 A 12/1968 Vogllano et al.
3,529,306 A * 9/1970 Thorne ..... A47C 27/00 297/452.17
3,872,511 A 3/1975 Nichols
3,877,076 A 4/1975 Summers et al.
4,012,794 A 3/1977 Nomiyama
4,024,586 A 5/1977 Lamb
4,064,565 A 12/1977 Griffiths
4,213,202 A 7/1980 Larry
4,239,106 A * 12/1980 Aileo ..... A42C 2/007 2/909
4,290,149 A 9/1981 Aileo
4,307,471 A 12/1981 Lovell
4,345,338 A 8/1982 Frieder et al.
4,412,358 A * 11/1983 Lavender ..... A42C 2/007 2/419
4,432,099 A 2/1984 Grick et al.
4,472,472 A 9/1984 Schultz
4,534,068 A 8/1985 Mitchell et al.
4,555,816 A 12/1985 Broersma
4,558,470 A * 12/1985 Mitchell ..... A42B 3/124 2/908
4,586,200 A 5/1986 Poon
4,627,114 A 12/1986 Mitchell
4,766,614 A * 8/1988 Cantwell ..... A42B 3/281 2/419
4,987,609 A 1/1991 Zahn
5,068,922 A 12/1991 Zahn
5,086,520 A 2/1992 Arai
5,142,700 A * 8/1992 Reed ..... H04B 1/385 455/344
5,204,998 A 4/1993 Liu
5,309,576 A 5/1994 Broersma
5,581,819 A 12/1996 Garneau
5,619,756 A 4/1997 Garneau
5,669,079 A 9/1997 Morgan
5,815,846 A 10/1998 Calonge
5,833,796 A 11/1998 Matich
5,950,244 A 9/1999 Fournier et al.
5,956,777 A 9/1999 Popovich
5,978,972 A 11/1999 Stewart et al.
6,009,566 A 1/2000 Hubbard
6,026,527 A * 2/2000 Pearce ..... B29C 48/08 428/137
6,052,835 A 4/2000 O'Shea
6,070,271 A 6/2000 Williams
6,070,905 A 6/2000 Renault
6,093,468 A 7/2000 Toms et al.
6,151,718 A * 11/2000 Shirai ..... A42B 3/281 2/184.5
6,314,586 B1 11/2001 Duguid
6,378,140 B1 4/2002 Abraham et al.
6,401,260 B1 6/2002 Porth
6,418,564 B1 7/2002 Sheridan
6,453,476 B1 9/2002 Moore, III
6,536,052 B2 3/2003 Tao et al.
6,560,787 B2 5/2003 Mendoza
6,658,671 B1 12/2003 Holst et al.
6,751,808 B2 6/2004 Puchalski
6,925,657 B2 8/2005 Takahashi et al.
6,931,669 B2 8/2005 Ashline
6,996,856 B2 2/2006 Puchalski
D521,191 S 5/2006 Berger
7,076,811 B2 7/2006 Puchalski
7,159,249 B2 1/2007 Dennis et al.
7,207,071 B2 4/2007 Pierce
7,299,505 B2 11/2007 Dennis et al.
7,328,462 B1 2/2008 Straus
7,376,981 B2 5/2008 Shida
7,574,754 B2 8/2009 Arai
7,676,854 B2 3/2010 Berger et al.
7,735,157 B2 6/2010 Ikeda
7,735,158 B2 6/2010 Tsurumi
7,748,059 B2 7/2010 Arai
7,774,866 B2 * 8/2010 Ferrara ..... B32B 5/18 2/455
7,802,320 B2 9/2010 Morgan
7,832,023 B2 11/2010 Crisco
7,895,681 B2 3/2011 Ferrara
7,930,771 B2 4/2011 Depreitere et al.
8,434,748 B1 * 5/2013 Pearce ..... A47C 27/20 5/655.5
8,955,169 B2 * 2/2015 Weber ..... A42B 3/125 2/425
9,388,873 B1 * 7/2016 Phipps ..... A43B 13/181
9,572,390 B1 * 2/2017 Simpson ..... A42B 3/125
10,010,126 B1 * 7/2018 Shaffer ..... A42B 3/283
10,212,983 B2 * 2/2019 Knight ..... A42C 2/002
10,271,603 B2 * 4/2019 Briggs ..... A42B 3/064
10,306,942 B2 6/2019 Hoshizaki et al.
10,362,829 B2 * 7/2019 Lowe ..... A42B 3/128
10,542,788 B2 * 1/2020 Simpson ..... A42B 3/128
2001/0032351 A1 10/2001 Nakayama et al.
2002/0023291 A1 2/2002 Mendoza
2004/0117896 A1 6/2004 Madey et al.
2005/0246824 A1 11/2005 Berger et al.
2006/0059606 A1 3/2006 Ferrara
2006/0070171 A1 * 4/2006 Copeland ..... A43B 13/181 2/455
2007/0083965 A1 * 4/2007 Darnell ..... F16F 7/121 2/9
2007/0190292 A1 8/2007 Ferrara
2007/0190293 A1 8/2007 Ferrara
2007/0000032 A1 9/2007 Morgan
2007/0226881 A1 * 10/2007 Reinhard ..... A42B 3/322 2/412
2008/0045871 A1 * 2/2008 Allen ..... A61F 5/05891 602/17
2008/0155735 A1 7/2008 Ferrara
2008/0256686 A1 10/2008 Ferrara
2009/0320185 A1 12/2009 Hassler
2010/0000009 A1 1/2010 Morgan
2010/0186150 A1 7/2010 Ferrara et al.
2010/0205722 A1 8/2010 Kim
2010/0258988 A1 10/2010 Darnell et al.
2010/0295221 A1 11/2010 Kligerman et al.
2011/0047678 A1 * 3/2011 Barth ..... A42B 3/124 2/411
2011/0047685 A1 3/2011 Ferrara
2011/0203038 A1 * 8/2011 Jones, Jr. ..... A42C 2/007 264/442
2012/0060251 A1 3/2012 Schimpf
2012/0139172 A1 6/2012 Hawkins et al.
2012/0151664 A1 6/2012 Kirshon
2012/0198604 A1 8/2012 Weber et al.
2012/0266366 A1 * 10/2012 Ferrara ..... F16F 7/121 267/140.13
2012/0297526 A1 * 11/2012 Leon ..... A63B 71/10 2/413
2013/0019385 A1 * 1/2013 Knight ..... A41D 13/015 2/411
2013/0125294 A1 * 5/2013 Ferrara ..... A42B 3/064 2/455
2013/0185837 A1 * 7/2013 Phipps ..... B60R 19/18 2/2.5
2013/0247284 A1 9/2013 Hoshizaki et al.
2013/0291289 A1 * 11/2013 Szalkowski ..... A42B 3/12 2/414
2013/0298316 A1 * 11/2013 Jacob ..... A42B 3/125 2/414
2013/0312167 A1 * 11/2013 Anderson ..... A42B 3/125 2/455
2013/0340146 A1 * 12/2013 Dekker ..... A42B 3/12 2/411
2014/0013491 A1 1/2014 Hoshizaki et al.

(56) References Cited

U.S. PATENT DOCUMENTS

| | | | | |
|---|---|---|---|---|
| 2014/0109299 | A1* | 4/2014 | Kwan | A41D 13/015 2/455 |
| 2015/0074875 | A1* | 3/2015 | Schimpf | A42B 3/064 2/411 |
| 2015/0157082 | A1 | 6/2015 | Weber et al. | |
| 2015/0264991 | A1* | 9/2015 | Frey | A63B 71/10 2/411 |
| 2016/0021965 | A1* | 1/2016 | Mayerovitch | A42B 3/064 2/414 |
| 2016/0316847 | A1* | 11/2016 | Weber | A42B 3/064 |
| 2017/0164678 | A1 | 6/2017 | Allen et al. | |
| 2017/0232327 | A1* | 8/2017 | Kuntz | A63B 71/081 2/413 |
| 2017/0290388 | A1 | 10/2017 | Briggs | |
| 2018/0317589 | A1* | 11/2018 | Mestas | A42B 3/064 |
| 2019/0029352 | A1* | 1/2019 | Sadegh | A42B 3/12 |
| 2021/0045487 | A1* | 2/2021 | Weber | A42B 3/064 |
| 2022/0322780 | A1* | 10/2022 | Weber | A42B 3/063 |
| 2022/0354202 | A1* | 11/2022 | Halldin | A42B 3/121 |

FOREIGN PATENT DOCUMENTS

| | | | |
|---|---|---|---|
| CN | 1997506 | | 7/2007 |
| CN | 101827537 | | 9/2010 |
| CN | 102406262 | A | 4/2012 |
| CN | 103635112 | A | 3/2014 |
| CN | 104244754 | A | 12/2014 |
| EP | 1142495 | | 10/2001 |
| EP | 2428129 | | 3/2012 |
| EP | 2672853 | | 12/2013 |
| WO | WO 2011/139224 | | 11/2011 |

* cited by examiner

OMNIDIRECTIONAL ENERGY MANAGEMENT SYSTEMS AND METHODS

CROSS-REFERENCE TO RELATED APPLICATIONS

This application is a continuation of International Patent Application No. PCT/US2019/030072, filed on Apr. 30, 2019 and entitled "OMNIDIRECTIONAL ENERGY MANAGEMENT SYSTEMS AND METHODS," which is incorporated herein by reference in its entirety.

The International Patent Application No. PCT/US2019/030072, filed on Apr. 30, 2019 claims priority to and the benefit of U.S. Provisional Patent Application No. 62/665,427 filed May 1, 2018 and entitled "OMNIDIRECTIONAL ENERGY MANAGEMENT SYSTEMS AND METHODS," which is incorporated herein by reference in its entirety.

This application is a continuation-in-part of U.S. patent application Ser. No. 16/792,172 filed Feb. 14, 2020, which is a continuation of U.S. patent application Ser. No. 15/186,418 filed Jun. 17, 2016 (now U.S. patent Ser. No. 10/561,192 issued Feb. 18, 2020) and entitled "OMNIDIRECTIONAL ENERGY MANAGEMENT SYSTEMS AND METHODS," which is incorporated herein by reference in its entirety. U.S. patent application Ser. No. 15/186,418 claims the benefit of and priority to U.S. Provisional Patent Application No. 62/181,121 filed Jun. 17, 2015 and entitled "OMNIDIRECTIONAL ENERGY MANAGEMENT SYSTEMS AND METHODS" and U.S. Provisional Patent Application No. 62/188,598 filed Jul. 3, 2015 and entitled "OMNIDIRECTIONAL ENERGY MANAGEMENT SYSTEMS AND METHODS," all of which are incorporated herein by reference in their entirety.

U.S. patent application Ser. No. 15/186,418 is a continuation-in-part of U.S. patent application Ser. No. 14/607,004 filed Jan. 27, 2015 (now U.S. Pat. No. 9,820,525 issued Nov. 21, 2017) and entitled "HELMET OMNIDIRECTIONAL ENERGY MANAGEMENT SYSTEMS." U.S. patent application Ser. No. 14/607,004 is a continuation of U.S. patent application Ser. No. 13/368,866 filed Feb. 8, 2012 (now U.S. Pat. No. 8,955,169 issued Feb. 17, 2015) and entitled "HELMET OMNIDIRECTIONAL ENERGY MANAGEMENT SYSTEMS," which is incorporated herein by reference in its entirety. U.S. patent application Ser. No. 13/368,866 claims the benefit of and priority to U.S. Provisional Patent Application No. 61/462,914 filed Feb. 9, 2011 and entitled "HELMET OMNIDIRECTIONAL ENERGY MANAGEMENT SYSTEMS," and U.S. Provisional Patent Application No. 61/554,351 filed Nov. 1, 2011 and entitled "HELMET OMNIDIRECTIONAL ENERGY MANAGEMENT SYSTEMS," all of which are incorporated herein by reference in their entirety.

TECHNICAL FIELD

One or more embodiments of the present invention generally relate to safety equipment, and more particularly for example, to protective helmets that protect the human head against repetitive impacts, moderate impacts and severe impacts so as to significantly reduce the likelihood of both translational and rotational brain injury and concussions.

BACKGROUND

Action sports (e.g., skateboarding, snowboarding, bicycle motocross (BMX), downhill mountain biking, and the like), motorsports (e.g., off-road and on-road car and motorcycle riding and racing) and traditional contact sports (e.g., football and hockey) continue to grow at a significant pace throughout the world as each of these sports expands into wider participant demographics. While technology and sophisticated training regimes continue to improve the performance capabilities for such athletes/participants, the risk of injury attendant to these activities also increases. Current "state of the art" helmets are not keeping pace with the evolution of sports and the capabilities of athletes. At the same time, science is providing alarming data related to the traumatic effects of both repetitive but moderate, and severe impacts to the head. While concussions are at the forefront of current concerns, rotational brain injuries from the same concussive impacts are no less of a concern, and in fact, are potentially more troublesome.

SUMMARY

In accordance with one or more embodiments of the present disclosure, omnidirectional impact energy management systems are provided for protective helmets that can significantly reduce both rotational and linear forces generated from impacts to the helmets over a broad spectrum of energy levels.

The novel techniques, for one or more embodiments, enable the production of hard-shelled safety helmets that can provide a controlled internal omnidirectional relative displacement capability, including relative rotation and translation, between the internal components thereof. The systems enhance modern helmet designs for the improved safety and well-being of athletes and recreational participants in sporting activities in the event of any type of impact to the wearer's head. These designs specifically address, among other things, the management, control, and reduction of angular acceleration forces, while simultaneously reducing linear impact forces acting on the wearer's head during such impacts.

In accordance with an embodiment, a helmet can be disclosed. The helmet can include an outer shell, a first liner disposed within and coupled to the outer shell, a second liner made from a first material and disposed within and coupled to the first liner, and a polymer liner made from a second material, coupled to the second liner, and disposed between the first liner and the second liner. The first liner can include a first protrusion that includes a first end facing the second liner.

The scope of this invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly, and within which like reference numerals are used to identify like elements illustrated in one or more of the figures thereof.

DETAILED DESCRIPTION

In accordance with one or more embodiments of this disclosure, omnidirectional impact energy management systems for helmets are provided that can significantly reduce both rotational and linear forces generated from impacts imparted to the helmets. The systems enable a controlled internal omnidirectional relative displacement capability, including relative rotational and translational movement, between the internal components of a hard shelled safety helmet.

One or more embodiments disclosed herein are particularly well suited to helmets that can provide improved protection from both potentially catastrophic impacts and repetitive impacts of varying force that, while not causing acute brain injury, can cause cumulative harm. The problem of cumulative brain injury, i.e., Second Impact Syndrome (SIS), is increasingly recognized as a serious problem in certain sports, such as American football, where much of the force of non-catastrophic contact is transferred to the head of the wearer. In various example embodiments, helmets are configured with dampers of specific flex and compression characteristics to manage a wide range of repetitive and severe impacts from all directions, thus addressing the multitude of different risks associated with diverse sports, such as football, baseball, bicycle riding, motorcycle riding, skateboarding, rock climbing, hockey, snowboarding, snow skiing, auto racing, and the like.

Head injuries result from two types of mechanical forces—contact and non-contact. Contact injuries arise when the head strikes or is struck by another object. Non-contact injuries are occasioned by cranial accelerations or decelerations caused by forces acting on the head other than through contact with another object, such as whiplash-induced forces. Two types of cranial acceleration are recognized, which can act separately or in combination with each other. "Translational" acceleration occurs when the brain's center of gravity (CG), located approximately at the pineal gland, moves in a generally straight line. "Rotational" or angular acceleration occurs when the head turns about its CG with or without linear movement of the CG.

Translational accelerations/decelerations can result in so-called "coup" and "contrecoup'" head injuries that respectively occur directly under the site of impact with an object and on the side of the head opposite the area that was impacted. By contrast, studies of the biomechanics of brain injury have established that forces applied to the head which result in a rotation of the brain about its CG cause diffuse brain injuries. It is this type of movement that is responsible for subdural hematomas and diffuse axonal injury (DAI), one of the most devastating types of traumatic brain injury.

Figure 1:
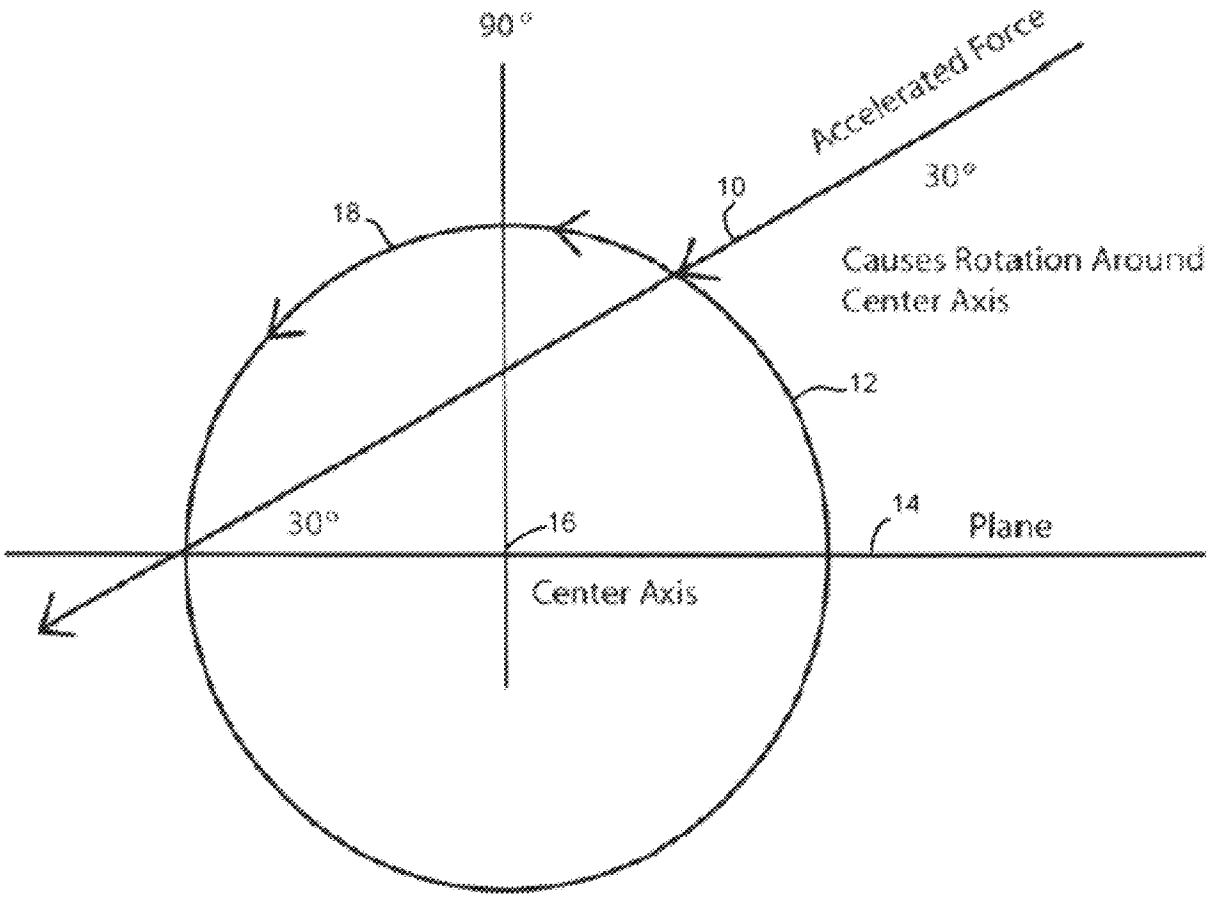
FIG. 1 is a diagram of an impact force acting on the head or helmet of a wearer so as to cause rotational acceleration of the wearer's brain around the brain's center of gravity.

Referring to FIG. 1, the risk of rotational brain injury is greatest when an impact force 10 is applied to the head or helmet 12 of a wearer from at an oblique angle, i.e., greater or less than 90 degrees to a perpendicular plane 14 drawn through the CG 16 of the brain. Such impacts cause rotational acceleration 18 of the brain around CG, potentially shearing brain tissue and causing DAI. However, given the distribution of brain matter, even direct linear or translational impacts can generate shear forces within the brain sufficient to cause rotational brain injuries. Angular acceleration forces can become greater, depending on the severity (i.e., force) of the impact, the degree of separation of the impact force 10 from 90 degrees to the perpendicular plane 14, and the type of protective device, if any, that the affected individual is wearing. Rotational brain injuries can be serious, long lasting, and potentially life threatening.

Safety helmets generally use relatively hard exterior shells and relatively soft, flexible, compressible interior padding, e.g., fit padding, foam padding, air filled bladders, or other structures, to manage impact forces. When the force applied to the helmet exceeds the capability of the combined resources of the helmet to reduce impacts, energy is transferred to the head and brain of the user at an accelerated rate. This can result in moderate concussion or severe brain injury, including a rotational brain injury, depending on the magnitude of the impact energy.

Safety helmets are designed to absorb and dissipate as much energy as possible over the greatest amount of time possible. Whether the impact causes direct linear or translational acceleration/deceleration forces or angular acceleration/deceleration forces, the helmet should eliminate or substantially reduce the amount of energy transmitted to the user's head and brain.

Figure 2:
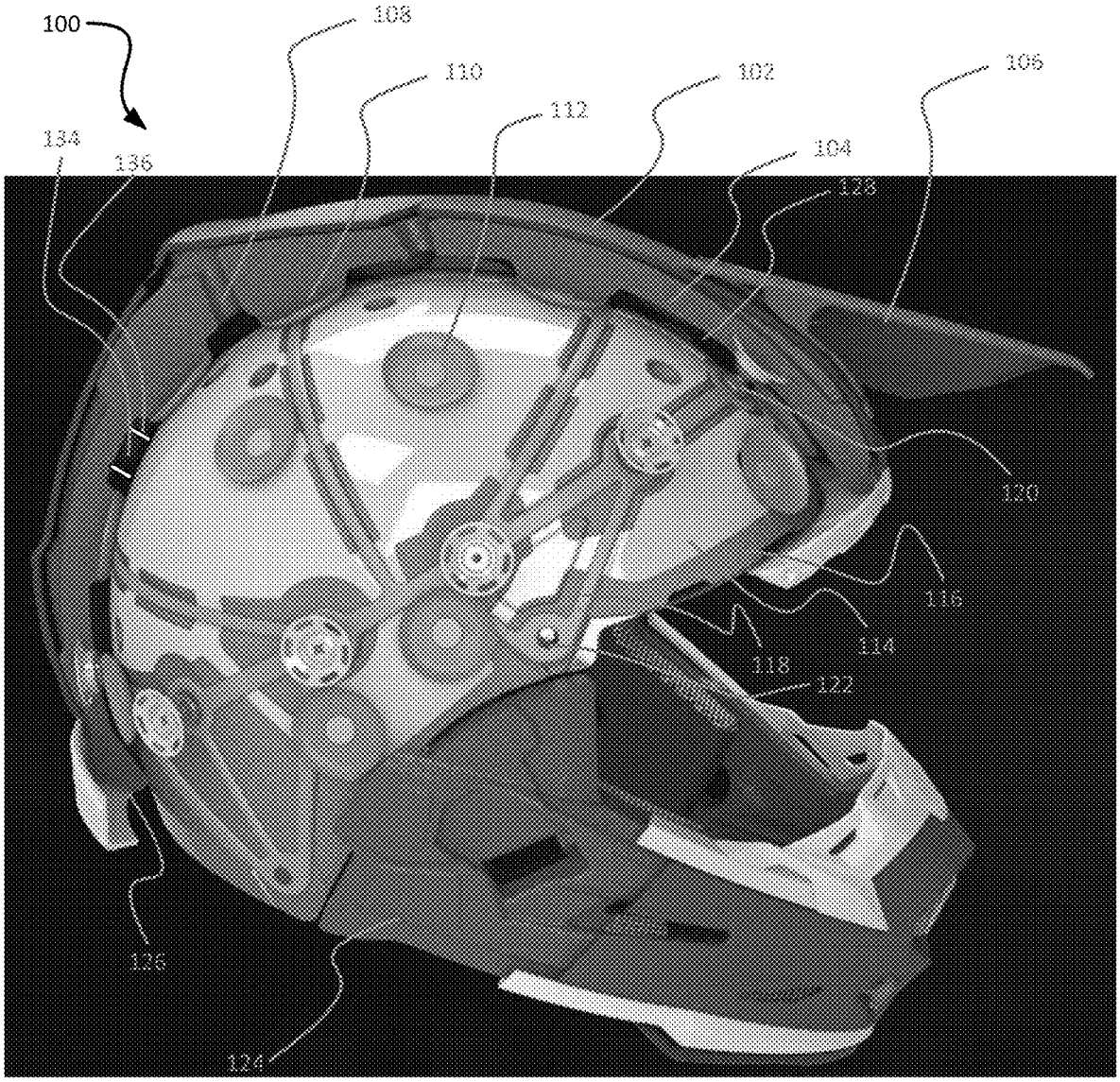
FIG. 2 is a prospective view of an example helmet, in accordance with an embodiment.

FIG. 2 is a prospective view of an example helmet, in accordance with an embodiment. FIG. 2 shows a helmet 100 that includes outer shell 102, first liner 104, polymer liner 114, second liner 116, carrier 118, dampers 120, and side liner 124.

Outer shell 102 can be a relatively hard shell that forms an outer structure that contains other components of helmet 100. The relatively hard outer shell 102 can be manufactured from conventional materials, such as fiber-resin lay-up type materials, polycarbonate plastics, polyurethane, or any other appropriate materials, in various thicknesses of material, depending on the specific application intended for the helmet 100.

First liner 104 can be coupled or connected (e.g., coupled via fasteners and/or adhesives or directly connected through in-molding or co-molding) to outer shell 102. Outer shell 102 can be disposed at least partially circumferentially around first liner 104. An outer side of first liner 104 can be configured to be disposed within an inner side of outer shell 102. A shape of the outer side of first liner 104 can substantially match a shape of an inner side of outer shell 102. In certain embodiments, the inner side of outer shell 102 and/or the outer side of first liner 104 can include one or more features to prevent first liner 104 from moving excessively relative to outer shell 102. The "inner side" can be the side of the component closer to the head of the wearer when helmet 100 is worn. By contrast, the "outer side" is the side of the component farther away from the head of the wearer when helmet 100 is worn.

First liner 104, second liner 116, and/or other liners can include various features configured for user comfort, to tune impact absorption, or both. For example, first liner 104 includes opening 108. Opening 108 can be configured to allow airflow to flow through first liner 104 to cool a wearer's head. Also, opening 108 can be configured to allow for first liner 104 to deflect more in certain directions, tuning the impact absorption property of first liner 104.

Second liner 116 can be configured to be disposed in contact with a wearer's head, either directly or via a fitment of a so-called "comfort liner." Second liner 116 can also be a hollow, semispheroidal, liner. First liner 104, second liner 116, and/or other liners can be formed of any suitable material, including energy absorbing materials such as expanded polystyrene (EPS) or expanded polypropylene (EPP). Such material can be configured to deform when subjected to a force (e.g., from an external impact). The deformation can absorb the force and protect a wearer's head. In certain embodiments, the force can be absorbed through a combination of one or more liners and/or other features additional to first liner 104 and second liner 116.

In certain embodiments, second liner 116 can be configured to be disposed circumferentially within first liner 104. In such configurations, an outer side of second liner 116 can be configured to be disposed within an inner side of first liner 104. A shape of the outer side of second liner 116 can substantially match a shape of an inner side of first liner 104.

In certain embodiments, the inner side of first liner 104 and/or the outer side of second liner 116 can include one or more features to prevent second liner 116 from moving excessively relative to first liner 104. However, certain embodiments can allow for second liner 116 to move relative to first liner 104 (e.g., can allow for rotation of second liner 116 relative to first liner 104). Such movement may be configured to be constrained such that relative movement is prevented if the relative movement is greater than a threshold amount. Such relative movement can prevent injury to the wearer (e.g., during oblique impacts).

One or more additional components can be disposed between second liner 116 and first liner 104. Such components can be configured to tune the allowable movement of second liner 116 relative to first liner 104. Polymer liner 114 can be one such component. Polymer liner 114 can be coupled to second liner 116, first liner 104, and/or another portion of helmet 100 via, for example, mechanical fasteners such as bolts, nuts, standoffs, pins, snaps, rivets 122, or other such fasteners, adhesives, friction fits, and/or another such technique. In certain other embodiments, polymer liner 114 can be co-molded onto second liner 116, first liner 104, and/or another portion of helmet 100.

Polymer liner 114 can create a low friction interface between mating part surfaces (e.g., between first liner 104 and second liner 116 or between other components such as between first liner 104 or second liner 116 and an intermediate liner). The low friction interface can allow and/or enhance rotational shearing movement between the components as, for example, polymer liner 114 can form a surface for first liner 104 and/or second liner 116 to slide, rotate, and/or move relative to one another on. Furthermore, polymer liner 114 can be coupled to or co-molded onto a surface of first liner 104, second liner 116 (e.g., an outer surface of second liner 116), and/or another component to create a structural member to enhance the structural strength of the component. Polymer liner 114 can enhance the strength of the component in compression loading, hoop tensile strength, and/or another structural aspect. Accordingly, polymer liner 114 can be constructed from a material with a higher modulus of elasticity. Also, polymer liner 114 can form a surface or base for other components to couple to (e.g., dampers, liners, rivets, and/or other such components).

In certain embodiments, first liner 104, second liner 116, and/or polymer liner 114 can include pads 112. Pads 112 can be tuned to control relative movement between first liner 104, second liner 116, polymer liner 114, and/or other components of helmet 100. For example, as shown in FIG. 2, pads 112 can be coupled to first liner 104. First liner 104 can include one or more protrusions 110 and pads 112 can be disposed on such protrusions. Disposing pads 112 on protrusions 110 allows for an air gap 128 to be disposed between first liner 104 and polymer liner 114 and/or second liner 116. Further, disposing pads 112 on protrusions 110 allow for tuning of the force required to move polymer liner 114 and/or second liner 116 relative to first liner 104. Other aspects to tune such force include the coefficient of friction of pads 112, the area of pads 112 that contact polymer liner 114 and/or second liner 116, and/or the amount of pads 112.

Air gap 128 can be disposed between liners of helmet 100, such as first liner 104 and second liner 116, to allow motion between the liners. In certain embodiments, air gap 128 can be partially or fully filled by compressible material 134. Compressible material 134 can be rubber dampers, damping towers, and/or compressible gels or foams in various geometric shapes. Such features can control displacement between the liners.

Thus, compressible material 134 can be coupled to first liner 104, second liner 116, and/or other liners to partially fill the gap between the liners. Compressible material 134 can be coupled to first liner 104, second liner 116, and/or other liners via mechanical fasteners, adhesives, and/or elastomeric bands 136. Elastomeric bands 136 can be attached to components (e.g., compressible material 134, first liner 104, second liner 116, another such liner, and/or other components of helmet 100) to couple two or more components together, but allow each component to displace linearly and/or shear rotationally relative to each other upon an impact. Elastomeric bands 136 can then pull the components back towards each other to position the components in the original positions after the impact event is over.

Protrusions 110 can be raised features such as towers, cylinders, cones, domes, ribs, standoffs, and/or other features. Protrusions 110 can be configured to create separation between two or more liners (e.g., first liner 104 and second liner 116). Such separation can create a gap that allows for linear and rotational displacement between the two liners. Certain embodiments can include a plurality of protrusions 110. The plurality of protrusions 110 includes protrusions of varying heights. The differences in height allows for different amounts of protrusions 110 to engage and, thus, prevent deformation at different compression levels of the liners. Thus, protrusions 110 can be tuned so that only some of protrusions 110 (and/or pads 112) contact polymer liner 114, second liner 116, and/or other liners of helmet 100 when unloaded (e.g., when helmet 100 is not experiencing an impact). The position of components of helmet 100 when not experiencing an impact can be called the unloaded position. When impact forces are experienced by helmet 100, larger forces result in progressively larger amounts of protrusions coming into contact with a corresponding liner. Having a larger amount of protrusions 110 increases resistance to deflection and, thus, prevents the liners from "bottoming out" and increases protection to the wearer.

While helmet 100 illustrates protrusions 110 disposed on first liner 104, other embodiments can dispose protrusions on other liners. Protrusions can be disposed on sides of one or both adjacent liners to separate the two liners and allow for creation of a gap for omnidirectional movement.

While pads 112 in certain embodiments can be a separate part from the liner, in other embodiments, pads 112 can be a portion of protrusion 110 that is the same material as protrusion 110 and/or a different material from protrusion 110 (e.g., a separate material that is co-molded or in-molded and/or connected via snaps, interlocking geometry features on each part, and/or bonding with adhesives). Pads 112, in certain embodiments, can also be coupled to a liner different or additional to the liner of pad 112 and/or coupled to carrier 118 via snaps, interlocking geometry features on each part, bonding with adhesives or in-molded or co-molded. One or more of pads 112 can be made from a low friction material and/or a rigid material. Pads 112 made from rigid materials can aid in distribution of forces from impact and thus provide further wearer protection.

Pads 112 can contact polymer liner 114, second liner 116, carrier 118, and/or another portion of helmet 100. In certain embodiments, pads 112 can be different coefficients of friction when contacting different surfaces. Thus, if pad 112 contacts polymer liner 114, the coefficient of friction can be a first coefficient of friction. If pad 112 contacts second liner 116, the coefficient of friction can be a second coefficient of friction and if pad 112 contacts carrier 118, the coefficient of friction can be a third coefficient of friction. In various embodiments, certain pads can be disposed on polymer liner 114, other pads disposed on second liner 116, and further pads disposed on carrier 118.

Pads 112 can be positioned so that, in certain directions of rotation, one or more of pads 112 can contact another component, changing the coefficient of friction and thus the force absorption property. For example, one or more of pads 112 can, in an unloaded position, be disposed on polymer liner 114. The interface of pad 112 to polymer liner 114 can be a first coefficient of friction. Rotation of polymer liner 114 relative to first liner 104 can then cause pad 112 to contact carrier 118. The interface of pad 112 to carrier 118 can be a second coefficient of friction and pad 112 riding over ridges of carrier 118 can provide additional resistance to movement. Thus, pads 112 can be configured to provide different amounts of rotational resistance (e.g., resistance of rotation of first liner 104 relative to polymer liner 114, second liner 116, and/or carrier 118) depending on the amount of rotation, and thus the positioning, of first liner 104 relative to polymer liner 114, second liner 116, and/or carrier 118. As such, positioning of pad 112 can tune rotational resistance of various liners to be progressive, digressive, or both at certain points of travel. Pad 112 can also be configured to be a connected body between two or more protrusions 110 and/or be a bridging surface supported by protrusion 110 and attached to protrusion 110 or first liner 104 with fasteners, pins, and/or adhesives, and/or bonded or co-molded into first liner 104 and/or second liner 116.

Carrier 118 can form a web like structure and/or be formed in another shape. Carrier 118 can be coupled to one or more liners and strengthen the one or more liners. Thus, carrier 118 can, for example, provide additional hoop strength to one or more liners (e.g., first liner 104 and/or second liner 116) and/or can prevent uncontrolled deflection of the liners and thus, for example, ensure that second liner 116 always maintains a certain general shape. The shape of carrier 118 can be similar to that of the inner and/or outer surface of first liner 104, second liner 116, polymer liner 114, and/or another such component.

Carrier 118 can be co-molded into second liner 116 so that the web like arms forming the web like structure are below the outside surface of second liner 116. In such a configuration, only specific areas of carrier 118 are disposed on or above an outer surface of second liner 116. Such specific areas can be configured to be attachment points for other components such as dampers or towers and/or to provide low friction points for contact with other components. Such a configuration allows for the carrier 118 to provide increased hoop strength to second liner 116, in addition to being configured to provide mounting and/or interface points for other components as described herein, while not or minimally creating additional surface features on the outside surface of second liner 116.

Carrier 118 can be disposed between a plurality of components (e.g., between second liner 116, first liner 104, and/or polymer liner 114) and coupled to one or more such components to provide a support structure for the components and/or to aid in aligning and positioning such components. For example, carrier 118 can be coupled to one or more of the components (e.g., coupled to second liner 116, first liner 104, polymer liner 114, and/or another component) through, for example, mechanical fasteners such as bolts, nuts, pins, snaps, standoffs, rivets 122, or other such fasteners, adhesives, friction fits, and/or another such technique.

Also, carrier 118 can align and/or position additional components such as compressible members, such as damping towers, elastomeric dampers, compressible foams, compressible gels or any component that controls displacement between two or more components (e.g., liners) in compression and/or shear. Such additional components can be coupled and/or attached to carrier 118 via techniques described herein (e.g., via the mechanical, adhesive, and/or friction fit techniques and/or co-molded into carrier 118) and can allow for omnidirectional displacement of components relative to one another.

An example of such a component is damper 120. Helmet 100 can include one or more dampers 120 coupled to various components. For example, dampers 120 can include a first end and a second end. Dampers 120 of helmet 100 can be coupled to carrier 118 at the first end and first liner 104 at the second end.

Dampers 120 can include the first end, and the second end, and a damper body disposed between the first end and the second end. The damper body can allow relative movement between the first end and the second end. For example, damper body can be flexible and allow the first end to translate and/or rotate relative to the second end. In certain embodiments, dampers 120 or a portion thereof can be elastomeric.

The first end and/or the second end of dampers 120 can include concave and/or convex features to couple to the respective liner and/or carrier. Such features can be complementary in shape to features of the respective liner and/or carrier. Dampers 120 can include elongated cylindrical members having opposite ends respectively retained within inserts attached to the respective liner and/or carrier. Such inserts can include a variety of different materials and configurations and can be attached to the corresponding liner and/or carrier via a variety of attachment techniques.

Dampers 120 can be provided at selected points around the circumfery of helmet 100. Dampers 120 of different designs can be provided for specific applications and effectively "tuned" to manage the anticipated rotational and translational forces applied thereto. Dampers 120 can be configured in a wide range of configurations and materials varying from those shown and described in the example embodiments, and the general principles described herein can be applied without departing from the spirit and scope of the invention.

Dampers 120, first liner 104, second liner 116, polymer liner 114, carrier 118, pads 112, and/or other features can be variously configured to control the amount of rotational force that will cause displacement of the various liners of the helmet 100 and can be configured such that they will tend to cause the second liner 116 to return to its original position relative to the first liner 104 after the force of an impact is removed from the helmet 100.

Side liner 124 can be a further liner of helmet 100. Side liner 124 can, for example, be configured to be disposed next to a jaw of the wearer when helmet 100 is worn. Side liner 124 can further be coupled to move relative to first liner 104, second liner 116, and/or another such liner in the event of an impact on helmet 100. Side liner 124 can be secured around the jaws of the wearer to secure orientation of helmet 100 to the face of the wearer. In certain embodiments, secondary 124 can be a portion or a segment of outer liner 104, inner liner 116, or another liner. Such a configuration is further described herein.

In certain embodiments, rearward portions of helmet 100 may include a rear cutout 126. Rear cutout 126 can be in alignment with the cervical area of the spine of the wearer. Rear cutout 126 can be a central cutout configured to allow for more clearance vertically from the bottom of helmet 100 in relation to the adjacent helmet material to the left and right of rear cutout 126. Rear cutout 126 allows for deflection of first liner 104, second liner 116, and/or other liners in an outward direction. Such deflection can be caused by, for example, rotational slip of helmet 100 in the aft direction (e.g., slip towards the rear of helmet 100). Rear cutout 126 allowing for deflection of first liner 104, second liner 116, and/or other liners can better protect the cervical spine area of the wearer by relieving pressure from the area by allowing for displacement of first liner 104, second liner 116, and/or other liners away from the area and, thus, preventing such displacement from exerting force on the cervical spine area.

Figure 3:
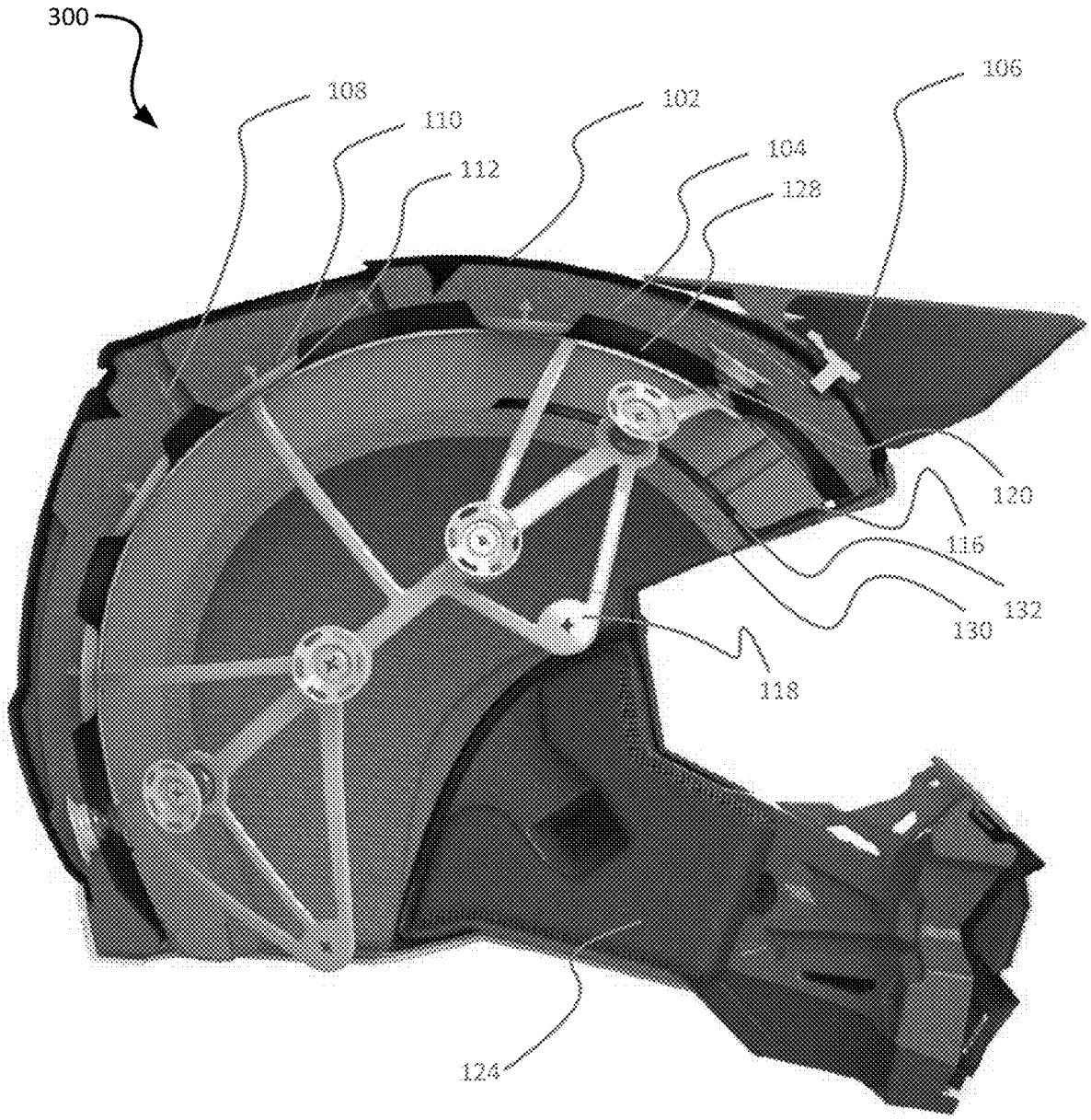
FIG. 3 is a partial side cross-sectional view of the example helmet, in accordance with an embodiment.

FIG. 3 is a partial side cross-sectional view of the example helmet, in accordance with an embodiment. Helmet 300 of FIG. 3 can be similar to helmet 100 of FIG. 2. However, FIG. 3 shows helmet 300 with third liner 130. Third liner 130 can be similar to liners described herein and can be configured to be disposed between a wearer's head and second liner 116 and be disposed in contact with the wearer's head, either directly or via a "comfort liner." Third liner 130 can be a hollow, semispheroidal liner formed from any suitable material, including energy absorbing materials such as expanded polystyrene (EPS) or expanded polypropylene (EPP) to deform when subjected to a force (e.g., from an external impact).

In various embodiments, the ratio of thickness between such a second liner 116 and third liner 130 may vary significantly. For example, in certain embodiments, second liner 116 may be made from a harder plastic material such as ABS, PC, PA6, or other suitable materials. Such an embodiment of second liner 116 may be only 1 to 3 millimeters thick. In such an embodiment, polymer liner 114 and second liner 116 may thus be incorporated into the same liner. Such an embodiment may include a third liner 130 that is much thicker than second liner 116. The thin second liner 116 may thus allow for third liner 130 to occupy more of the available volume space and. Such a configuration would allow for second liner 116 to move omnidirectionally in relation to first liner 104 while third liner 130 is configured of thick energy absorbing foam (significantly thicker than second liner 116, such as between 5 to 50 millimeters thick) that will contact the wearer's head either directly or via a comfort liner, increasing user comfort. In other embodiments, second liner 116 may be similar in thickness to third liner 130 or second liner 116 may be thicker than third liner 130.

Third liner 130 can be disposed within second liner 116 and can be configured to move (e.g., translate and/or rotate) relative to second liner 116. Air gap 132 can be disposed between third liner 130 and second liner 116 to allow for displacement of second liner 116 relative to third liner 130 and/or vice versa. Air gap 132, similar to air gap 128, is a space for second liner 116 and/or third liner 130 to compress and/or displace into and, thus, allows for omnidirectional displacement in linear and shear of second liner 116 and/or third liner 130. Furthermore, in certain embodiments, first liner 104, second liner 116, and/or third liner 130 can be formed from the same or different materials with different stiffness. In certain such embodiments, second liner 116 can be softer than first liner 104 and/or third liner 130 and can, thus, effectively function as a gap that allows for third liner 130 to move (e.g., translate and/or rotate) relative to first liner 104.

In certain embodiments, second liner 116 can be configured to be disposed circumferentially within first liner 104. In such configurations, an outer side of second liner 116 can be configured to be disposed within an inner side of first liner 104. A shape of the outer side of second liner 116 can substantially match a shape of an inner side of first liner 104.

Figure 4:
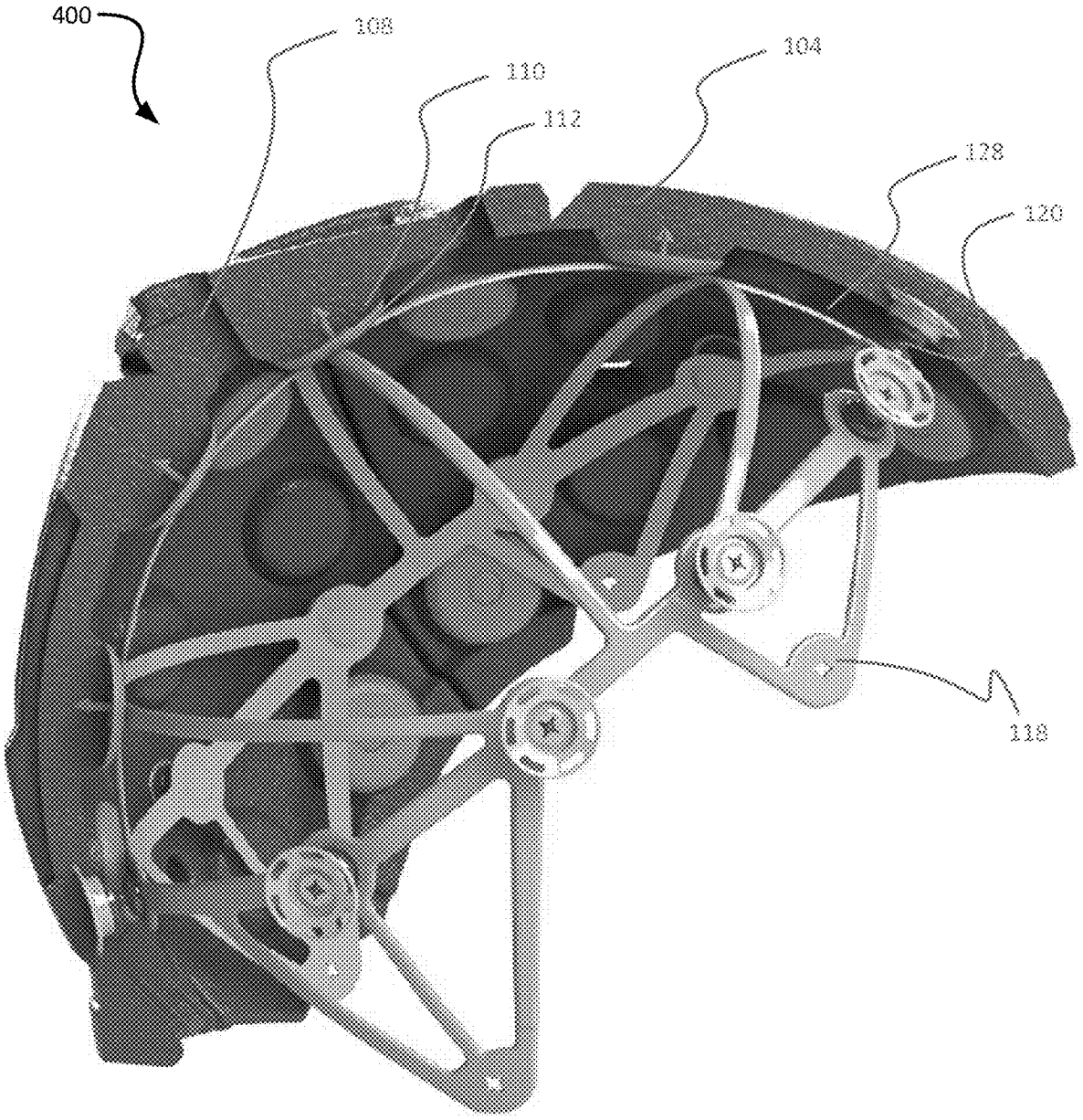
FIG. 4 is a partial side cross-sectional view of certain components of the example helmet, in accordance with an embodiment.

FIG. 4 is a partial side cross-sectional view of certain components of the example helmet, in accordance with an embodiment. Helmet 400 of FIG. 4 illustrates carrier 118. Dampers 120 are coupled to carrier 118 and first liner 104. As shown in FIG. 4, a first end of dampers 120 can be disposed within an opening of first liner 104. Disposing the first end within the opening can allow for first liner 104 to securely hold damper 120. A second end of damper 120 can be coupled to carrier 118. In certain embodiments, the second end of damper 120 can be molded to carrier 118 or can be separate from carrier 118 and coupled to carrier 118. Damper 120 can allow for and control movement of first liner 104 relative to carrier 118.

Furthermore, as shown in FIG. 4, pads 112 can be inserted into protrusions 110 and held within protrusions through a barb on an end of pads 112. At least some of pads 112 can be configured to contact carrier 118 when in an unloaded position. Certain displacement of first liner 104 relative to carrier 118 can then move certain pads 112 so that they no longer contact carrier 118.

Figure 5:
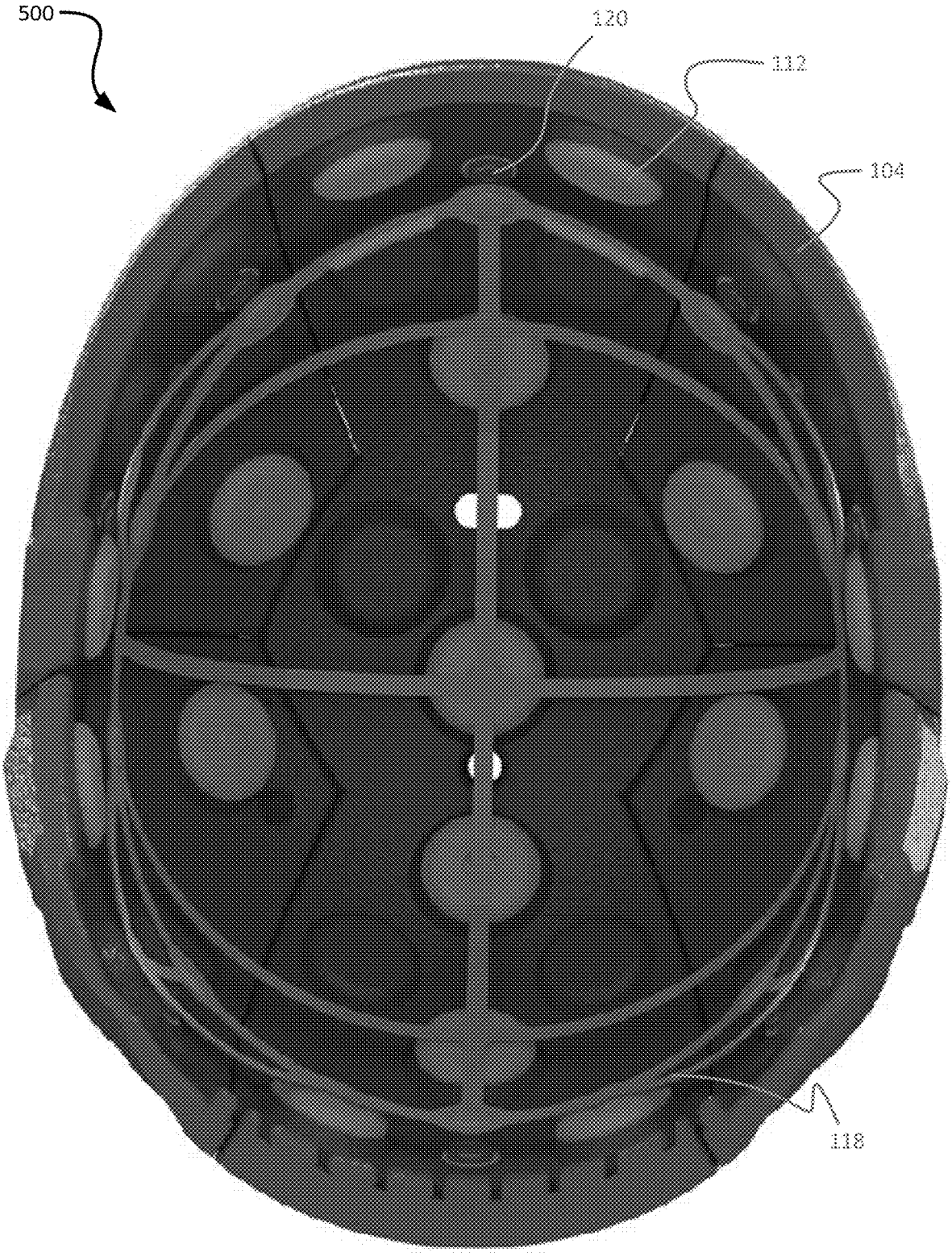
FIG. 5 is a bottom view of certain components of the example helmet, in accordance with an embodiment.

FIG. 5 is a bottom view of certain components of the example helmet, in accordance with an embodiment. FIG. 5 shows helmet 500 with pads 112 and carrier 118. As shown in FIG. 5, certain pads 112 do not contact carrier 118 in an unloaded position. In certain such embodiments, pads 112 will only contact carrier 118 or another portion of helmet 500 (not shown) if helmet 500 experiences a force greater than a threshold force that leads to deflection of certain components greater than a threshold deflection amount.

Figure 6:
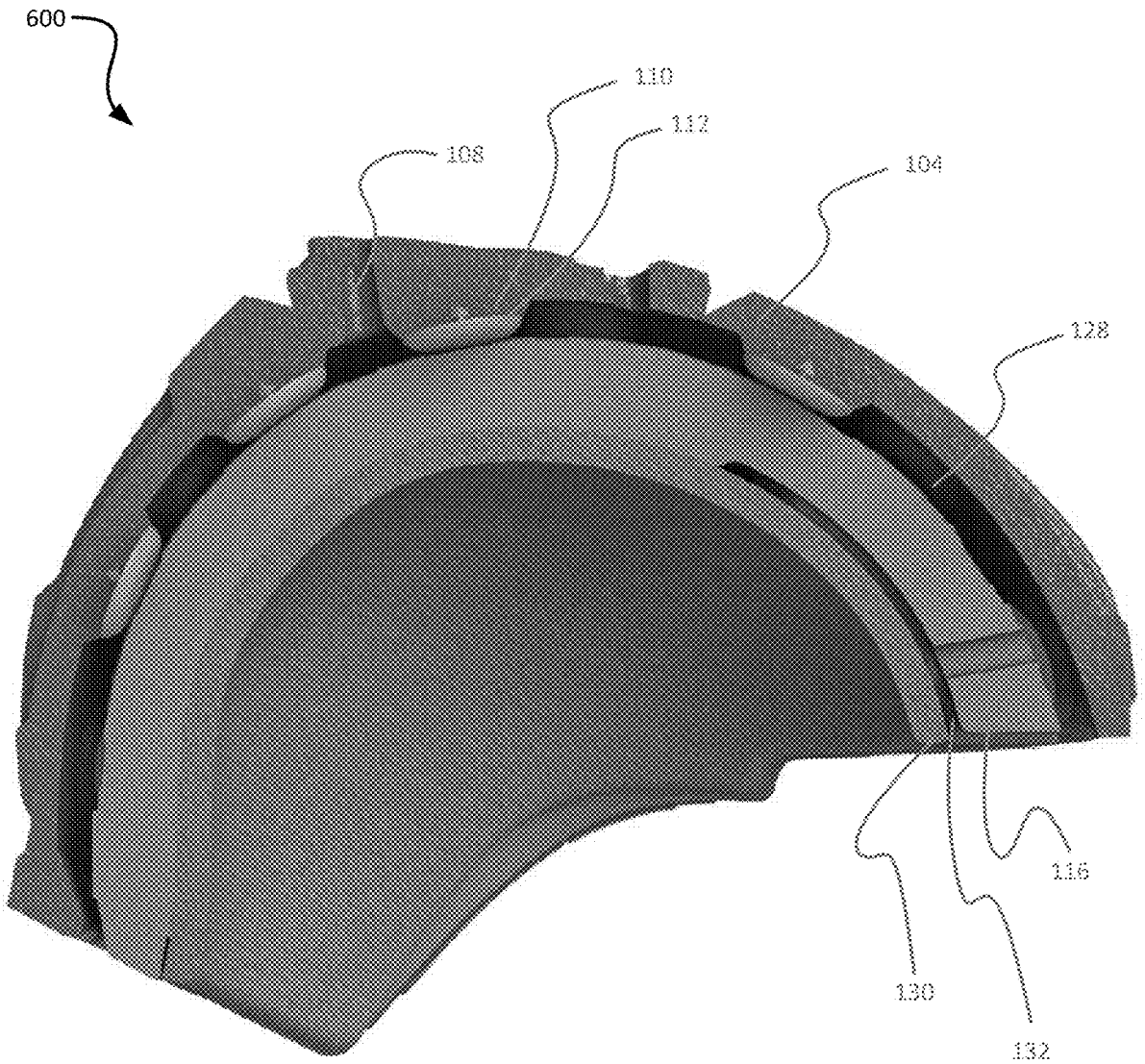
FIG. 6 is a side cross-sectional view of certain components of the example helmet, in accordance with an embodiment.

FIG. 6 is a side cross-sectional view of certain components of the example helmet, in accordance with an embodiment. Helmet 600 shows first liner 104, second liner 116, and third liner 130. Air gap 128 is disposed between first liner 104 and second liner 116. Air gap 132 is disposed between second liner 116 and third liner 130. While in the unloaded position, portions of first liner 104 can contact second liner 116 and portions of second liner 116 can contact third liner 130, but air gaps 128 and 132 allow for deflection of liners relative to each other when experiencing a load on helmet 600. In certain embodiments, air gaps 128 and/or 132 can be fully or partially filled with compressible materials such as rubber dampers, damping towers, and/or compressible gels or foams in various geometric shapes.

Figure 7:
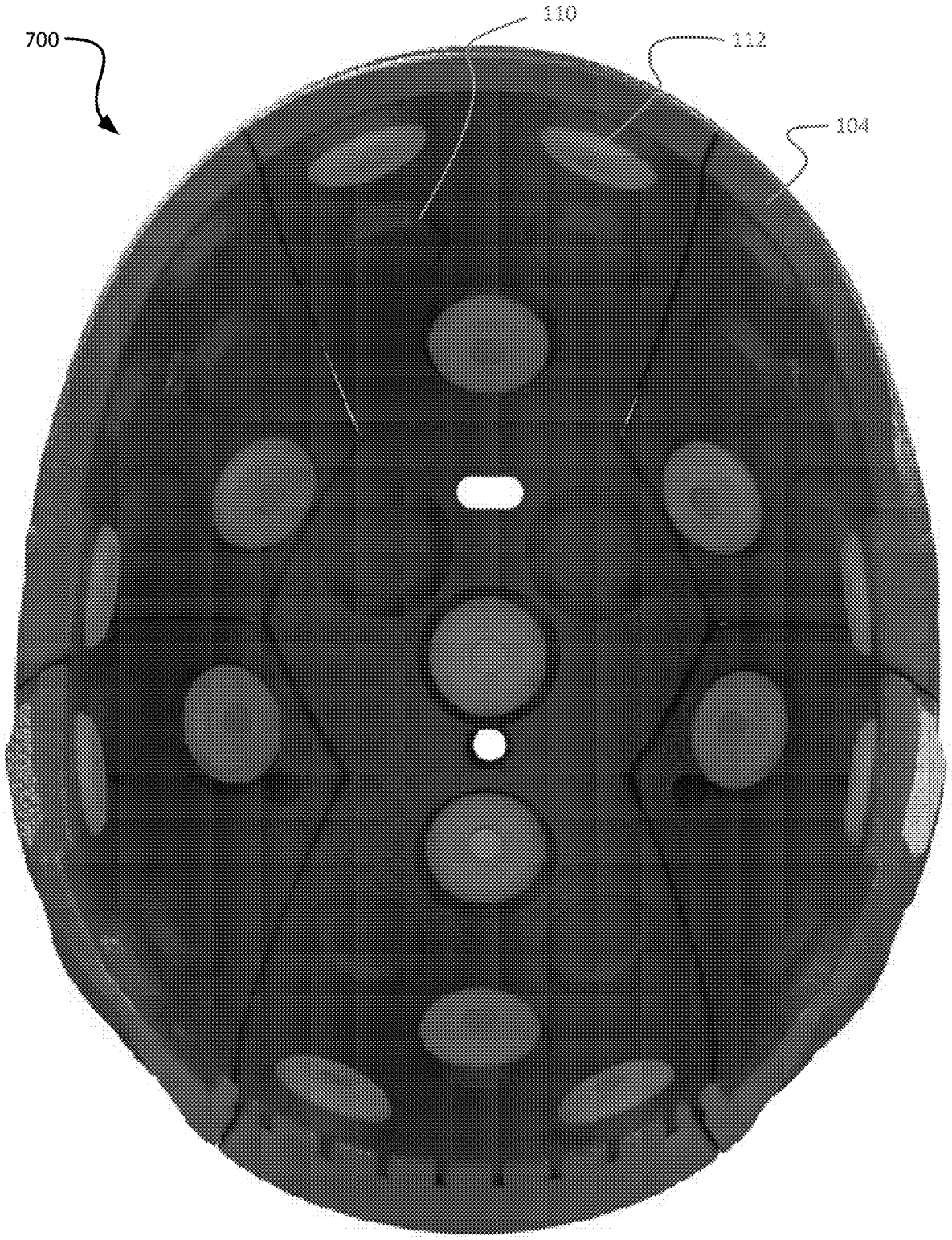
FIG. 7 is a bottom view of certain components of the example helmet, in accordance with an embodiment.

FIG. 7 is a bottom view of certain components of the example helmet, in accordance with an embodiment. As shown in FIG. 7, first liner 104 of helmet 100 includes a plurality of sections. Such sections can be defined by grooves or cuts within first liner 104. Dividing first liner 104 into sections allows for first liner 104 to further accommodate omnidirectional movement. The various sections of first liner 104 can move relative to each other for at least a first distance and thus can move independently or semi-independently of other sections. In other embodiments, other liners (e.g., second liner 116 and/or third liner 130) can, additionally or alternatively, be multi-section liners.

Protrusions 110 and pads 112 can be disposed on various sections of the liners. As shown in FIG. 7, certain pads 112 can be coupled to certain protrusions, but other protrusions may not be coupled to pads 112. As the coefficient of friction of bare protrusions and pads can be different, disposing pads on certain protrusions, but not all protrusions, can be used to tune the impact absorption and resistance to movement of the liners.

Figure 8:
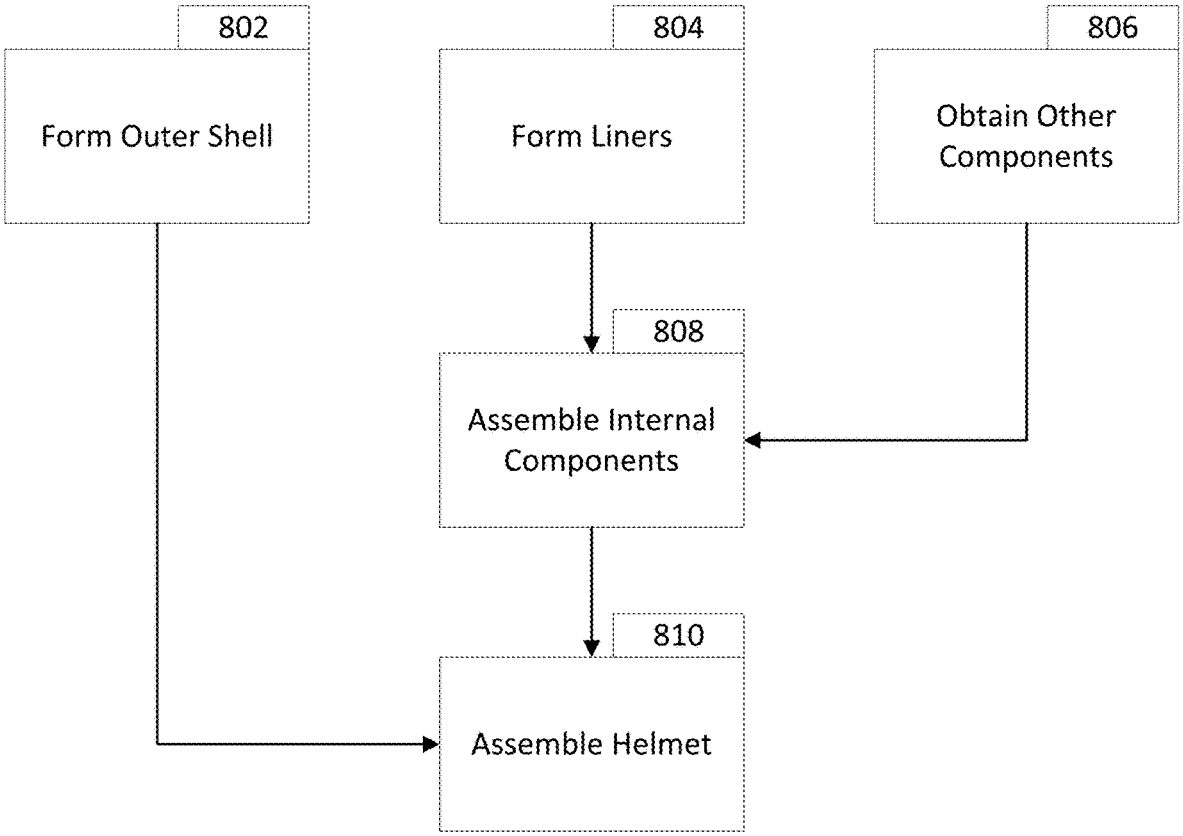
FIG. 8 is a flowchart detailing a method of manufacturing of the example helmet, in accordance with an embodiment.

FIG. 8 is a flowchart detailing a method of manufacturing of the example helmet, in accordance with an embodiment. In block 802, the outer shell of the helmet can be formed. The outer shell can be formed from plastics, composites, and/or other materials appropriate for a hard outer shell of a helmet via lay-up, vacuum forming, injection molding, and/or another appropriate process.

In block 804, liners of the helmet are formed. Liners can be formed of any suitable material, including energy absorbing materials such as expanded polystyrene (EPS) or expanded polypropylene (EPP). Further, additional components (e.g., dampers, rivets, carriers) can be formed and/or obtained in block 806.

The liners and components can be assembled in block 808 by fastening together, gluing, and/or other coupling via other techniques the liners and/or components. The internal components of the helmet can then be coupled to the outer shell in block 810 (e.g., via Velcro padding, adhesives, fasteners, and/or other techniques) to form a complete helmet. In certain embodiments, assembling certain liner(s) and/or other component(s) can form liner assemblies. Such liner assemblies can then be coupled to multiple other parts and/or assemblies to form a complete helmet.

Other embodiments of the impact absorbing system may include any of the impact absorbing system configurations detailed herein in various safety helmets (e.g., sports helmets, construction helmets, racing helmets, helmets worn by armed forces personnel, helmets for the protection of people such as toddlers, bicycle helmets, pilot helmets, and other helmets) as well as in various other safety equipment designed to protect a wearer. Non-limiting examples of such other safety equipment may include body armor such as vests, jackets, and full body suits, gloves, elbow pads, shin pads, hip pads, shoes, helmet protection equipment, and knee pads.

By using different materials and configurations, it is possible to adjust or tune the protection provided by helmets that use the systems of the disclosure, as would be understood by one skilled in the art. The liners and any other layers can be formed from materials with distinct flexibility, compression, and crush characteristics, and the isolation dampers can be formed from various types of elastomers or other appropriate energy absorbing materials, such as MCU. Thus, by controlling the density and stiffness of the isolation dampers and related internal constructional materials, safety helmets can be configured to strategically manage impact energy based on the known range of common head weights expected to be present in any given helmet, and by helmet size, and by any give sporting activity.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but should be accorded the widest possible scope consistent with the principles and features disclosed herein.

What is claimed is:

1. A helmet comprising:

an outer shell;

a first liner disposed within and coupled to the outer shell, the first liner comprising a first protrusion with a first end disposed on a side of the first liner facing away from the outer shell;

a second liner comprising a first material and disposed within and coupled to the first liner; and a polymer liner comprising a second material different from the first material, coupled to the second liner, and disposed between the first liner and the second liner.

2. The helmet of claim 1, wherein the first liner further comprises a second protrusion facing the second liner.

3. The helmet of claim 1, wherein the first liner comprises the first material.

4. The helmet of claim 1, wherein the first liner comprises a third material.

5. The helmet of claim 1, further comprising an air gap between the first liner and the second liner and/or the polymer liner.

6. The helmet of claim 5, further comprising a compressible structure coupled to the first liner and/or the second liner and disposed within at least a portion of the air gap.

7. The helmet of claim 1, further comprising a damper comprising a first damper end coupled to the first liner.

8. The helmet of claim 7, further comprising a carrier coupled to the second liner, wherein a second damper end of the damper is coupled to the carrier.

9. The helmet of claim 8, wherein the carrier is in-molded or co-molded to the second liner.

10. The helmet of claim 1, wherein the outer shell, the first liner, and/or the second liner each comprise a rear cutout configured to be in alignment with a cervical area of a wearer of the helmet.

11. The helmet of claim 1, further comprising a third liner disposed within and coupled to the second liner.

12. The helmet of claim 1, wherein the first liner and/or the second liner are multi-section liners.

13. A method of manufacturing the helmet of claim 1, the method comprising:

coupling the polymer liner to the second liner to form a liner assembly;

coupling the liner assembly to the first liner; and coupling the first liner to the outer shell.

14. The method of claim 13, further comprising coupling a carrier to the first liner via a damper.

15. The method of claim 13, wherein the coupling the polymer liner to the second liner comprises co-molding the second liner and the polymer liner to form the liner assembly.

16. The helmet of claim 6, wherein the compressible structure is coupled to the first liner and/or the second liner via an elastomeric band.

17. The helmet of claim 2, further comprising a first pad coupled to the first end of the first protrusion, wherein a first coefficient of friction between the first pad and the polymer liner is less than a second coefficient of friction between the second protrusion and the polymer liner.

18. The helmet of claim 1, wherein the second material comprises a second modulus of elasticity higher than a first modulus of elasticity of the first material, wherein the second liner comprises a first thickness and the polymer liner comprises a second thickness, and wherein the first thickness is thicker than the second thickness.

19. The helmet of claim 1, further comprising a first pad coupled to the first end of the first protrusion.

20. The helmet of claim 2, wherein the first protrusion is configured to contact the polymer liner when the helmet is in an unloaded position and the second protrusion is configured to not contact the polymer liner and/or the second liner when the helmet is in the unloaded position.

* * * * *